US010116085B1

(12) United States Patent
Quinteros et al.

(10) Patent No.: US 10,116,085 B1
(45) Date of Patent: Oct. 30, 2018

(54) SEALED CONNECTOR WITH AN EXTENDED SEAL SLEEVE AND RETAINER

(71) Applicant: Delphi Technologies, LLC, Troy, MI (US)

(72) Inventors: Francisco Javier O. Quinteros, Saltillo (MX); Jose Eduardo R. Mares, Saltillo (MX)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/973,757

(22) Filed: May 8, 2018

(51) Int. Cl.
*H01R 13/58* (2006.01)
*H01R 13/52* (2006.01)
*H01R 13/533* (2006.01)

(52) U.S. Cl.
CPC ..... *H01R 13/521* (2013.01); *H01R 13/533* (2013.01); *H01R 13/5825* (2013.01)

(58) Field of Classification Search
CPC ..... H01R 13/521; H01R 13/5213; H01R 13/5221; H01R 13/533; H01R 13/5825
USPC ..... 439/470–472
See application file for complete search history.

(56) References Cited

U.S. PATENT DOCUMENTS 5,569,051 A * 10/1996 Endo ..... H01R 13/42 439/587
8,905,783 B2 * 12/2014 Umemoto ..... H01R 33/965 439/274
9,577,367 B2 2/2017 Campbell et al.
9,985,381 B2 * 5/2018 Nguyen Nhu ..... H01R 13/5205

FOREIGN PATENT DOCUMENTS

WO 2017179366 A1 10/2017

* cited by examiner

*Primary Examiner* — Khiem Nguyen
(74) *Attorney, Agent, or Firm* — Robert J. Myers

(57) ABSTRACT

A connector assembly includes a connector body defining a cylindrical terminal cavity, an elongate conductor, such as an electrical cable, having one end terminated within the first terminal cavity, and a cylindrical first seal axially surrounding a portion of the first conductor. The seal defines a compliant primary sealing ring that is in compressive contact with an inner wall of the terminal cavity. The first seal further defines an elongate frustoconical sleeve. The connector assembly also includes a seal retainer that is attached to the connector body. The seal retainer defines an elongate frustoconical retainer cavity configured to receive first sleeve. At least a portion of the sleeve is in compressive contact an inner surface of the retainer cavity.

10 Claims, 3 Drawing Sheets

SEALED CONNECTOR WITH AN EXTENDED SEAL SLEEVE AND RETAINER

TECHNICAL FIELD OF THE INVENTION

The invention generally relates to a sealed connector, and more particularly relates to a connector having a seal with an extended sleeve and a seal retainer configured to dampen vibration of a cable within the seal.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

A connector assembly that includes a connector body, an elongated conductor, such as an electrical cable, a seal surrounding the conductor, and a retainer configured to secure the seal within the connector body is presented herein. The seal includes a sleeve extending along the conductor from the sealing ring of the seal. The seal retainer is fitted over the sleeve and is in compressive contact with the sleeve, thereby providing strain relief for the conductor and dampening vibration of the conductor.

Figure 1:
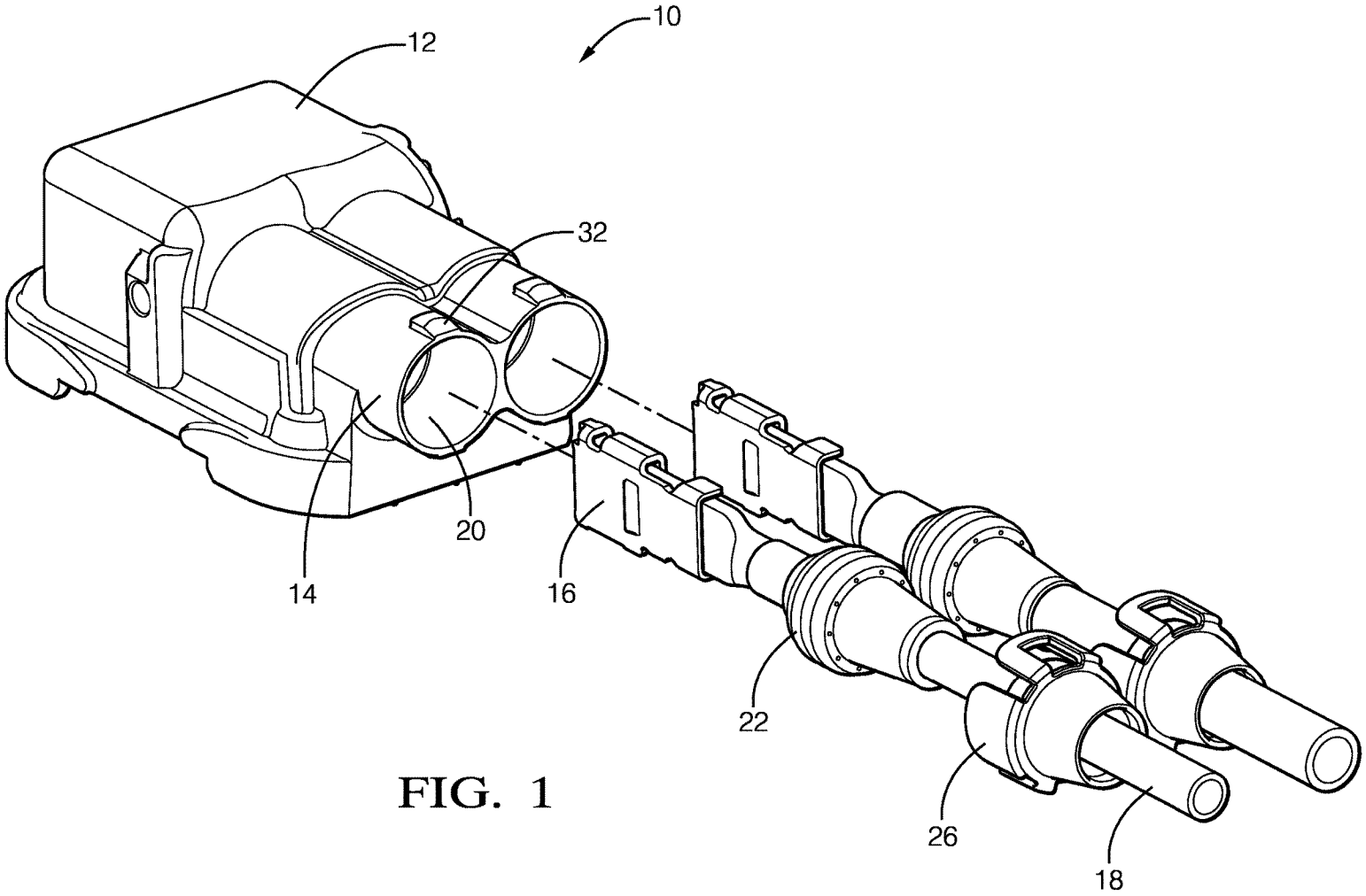
FIG. 1 is an exploded perspective view of a connector having a cable seal and a seal retainer in accordance with one embodiment.

FIGS. 1-5 illustrate a non-limiting example of a connector assembly 10. As shown in FIG. 1, the connector assembly 10 includes a connector body 12 having a plurality of terminal towers 14 configured to accommodate a terminal 16 attached to a wire cable 18. The connector body 12 is formed of a dielectric material, such as glass- filled polyamide (PA) or polybutylene terephthalate (PBT). Each terminal tower 14 defines a substantially cylindrical terminal cavity 20 that is configured to receive and retain the terminated cable 18.

Each terminated cable 18 includes a cable seal 22 that axially surrounds a portion of the terminated cable 18. The cable seal 22 is made of a compliant material, such as a silicone rubber. The cable seal 22 defines a compliant primary sealing ring 24 that is configured to be in compressive contact with an inner wall of the terminal cavity 20. As used herein, compressive contact produces a reaction force between the sealing ring 24 and the inner wall of the terminal cavity 20. The sealing ring 24 is designed to block water and/or other environmental contaminants from intruding into the connector body 12 and contaminating the terminal 16. The cable seal 22 also defines a substantially frustoconical sleeve 26 that axially extends along the wire cable 18 from the sealing ring 24.

Figure 2:
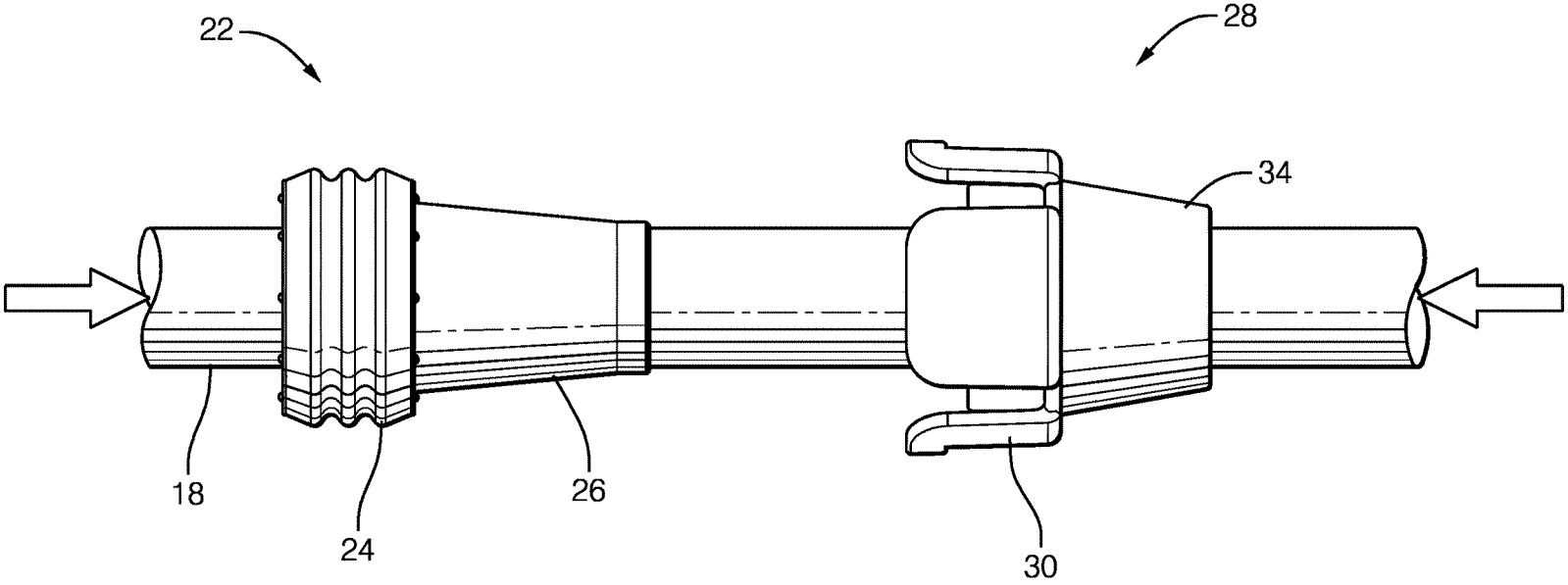
FIG. 2 is an exploded side view of the cable seal and seal retainer of FIG. 1 in accordance with one embodiment.
Figure 3:
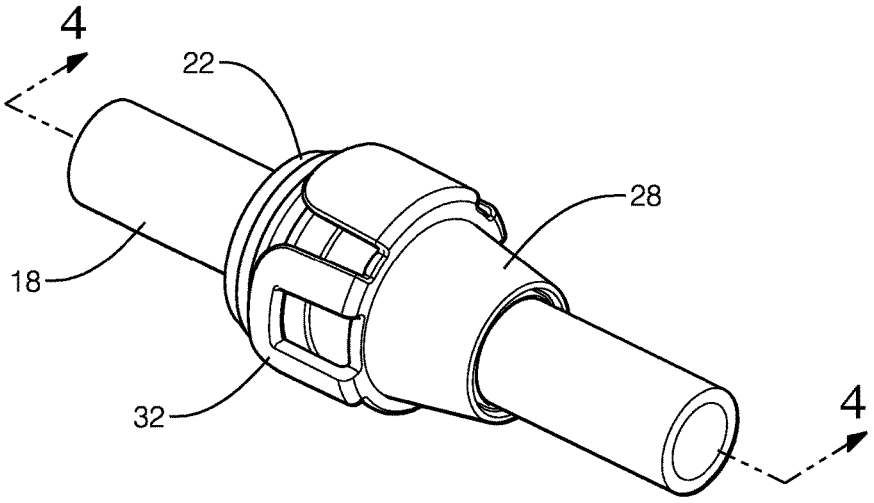
FIG. 3 is a perspective view of the cable seal and seal retainer of FIG. 1 in an assembled condition in accordance with one embodiment.
Figure 4:
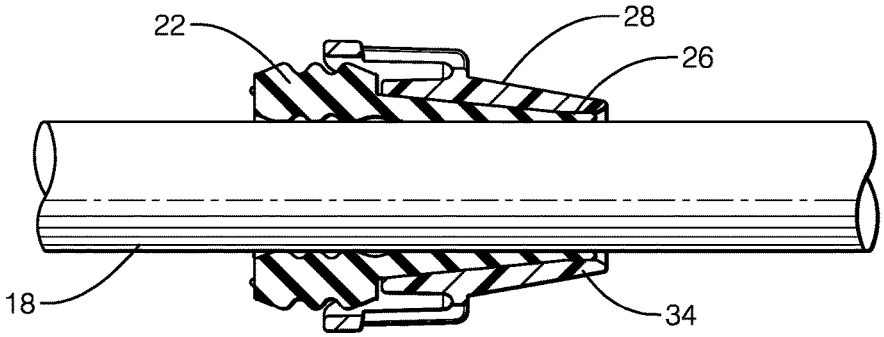
FIG. 4 is a side cross-sectional view of the connector of FIG. 3 in accordance with one embodiment.

The connector assembly 10 further includes a seal retainer 28 that is configured to secure the cable seal 22 within the terminal cavity 20. The seal retainer 28 is attached to the connector body 12 and cooperates with the cable seal 22 to provide strain relief for the terminated cable 18. As shown in FIG. 2, the seal retainer 28 is slid along the cable until the seal retainer 28 is secured to the connector body 12 by a pair of U-shaped arms 30 projecting from the seal retainer 28 that snap over teeth 32 defined by the connector body 12. The seal retainer 28 axially surrounds at least a portion of the sleeve 26 of the cable seal 22. The seal retainer 28 is formed of a dielectric material such as PA, PBT, or polypropylene (PP). The seal retainer 28 has a retainer tower 34 that extends from the seal retainer 28 and defines a frustoconical retainer cavity 36 configured to receive the sleeve 26. At least a portion of the cable seal 22 is in compressive contact an inner surface of the retainer cavity 36.

The seal retainer 28 is configured to provide strain relief for the second electrical cable. The seal retainer 28 and the sleeve 26 of the cable seal 22 cooperate to dampen vibration of the terminal 16 caused by vibration transmitted by the electrical cable.

As shown in FIG. 1, the cable seal 22 and seal retainer 28 may be designed so that one seal retainer 28 may be used with terminated cables having different cable diameters. The outer diameter of the cable seal 22 remains the same for every different cable diameter while only the inner diameter of the cable seal 22 is changed to accommodate the cable diameter. This provides the benefit of eliminating different seal retainers to accommodate seals for different cable diameters.

The examples presented herein are directed to electrical connectors, however other embodiments of the connector may be envisioned that are adapted for use with optical cables or hybrid connectors including both electrical cables and optical cable connections. Yet other embodiments of the connector may be envisioned that are configured to interconnect pneumatic or hydraulic lines.

Accordingly, a connector assembly 10 having cable seals 22 and seal retainers 28 that cooperate to provide improved vibration dampening and strain relief for the terminated cables. The cable seals 22 and the seal retainers 28 further provide the benefit of accommodating a wide range of cable diameters.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description.

The scope of the invention should, therefore, be determined with reference to the following claims, along with the full scope of equivalents to which such claims are entitled.

In the following claims, the terms "including" and "in which" are used as the plain-English equivalents of the respective terms "comprising" and "wherein." Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

We claim:

1. A connector assembly, comprising:

a connector body defining a cylindrical first terminal cavity;

an elongate first conductor having one end terminated within the first terminal cavity;

a cylindrical first seal axially surrounding a portion of the first conductor, said first seal defining a compliant primary sealing ring in compressive contact with an inner wall of the first terminal cavity, said first seal further defining an elongate first sleeve having frustoconical shape; and a first seal retainer attached to the connector body having a first retainer tower extending therefrom defining an elongate frustoconical first retainer cavity configured to receive the first sleeve, wherein at least a portion of the first sleeve is in compressive contact an inner surface of the first retainer cavity.

2. The connector assembly in accordance with claim 1, wherein the connector body defines a cylindrical second terminal cavity and wherein the connector assembly further comprises:

an elongate second conductor having one end terminated within the second terminal cavity and having a second conductor diameter that is different from the first conductor diameter, a cylindrical second seal axially surrounding a portion of the second conductor, said second seal defining a compliant primary sealing ring in compressive contact with an inner wall of the second terminal cavity, said second seal further defining an elongate frustoconical second sleeve; and a second seal retainer attached to the connector body having a second retainer tower extending therefrom defining an elongate frustoconical second retainer cavity configured to receive the second sleeve, wherein at least a portion of the second sleeve is in compressive contact an inner surface of the second retainer cavity.

3. The connector assembly in accordance with claim 2, wherein the second retainer is configured to provide strain relief for the second conductor and wherein the second retainer and the second sleeve cooperate to dampen vibration of the second conductor.

4. The connector assembly in accordance with claim 2, wherein the first retainer is dimensionally identical to the second retainer.

5. The connector assembly in accordance with claim 1, wherein the first retainer is configured to provide strain relief for the first conductor and wherein the first retainer and the first sleeve cooperate to dampen vibration of the first conductor.

6. An electrical connector assembly, comprising:

a connector body defining a cylindrical first terminal cavity;

an elongate first electrical cable having one end terminated within the first terminal cavity and having a first cable diameter;

a cylindrical first seal axially surrounding a portion of the first electrical cable, said first seal defining a compliant primary sealing ring in compressive contact with an inner wall of the first terminal cavity, said first seal further defining a frustoconical first sleeve; and a first seal retainer attached to the connector body having a first retainer tower extending therefrom defining a frustoconical first retainer cavity configured to receive the first sleeve, wherein at least a portion of the first sleeve is in compressive contact an inner surface of the first retainer cavity.

7. The electrical connector assembly in accordance with claim 6, wherein the connector body defines a cylindrical second terminal cavity and wherein the electrical connector assembly further comprises:

an elongate second electrical cable having one end terminated within the second terminal cavity and having a second cable diameter that is different from the first cable diameter, a cylindrical second seal axially surrounding a portion of the second electrical cable, said second seal defining a compliant primary sealing ring in compressive contact with an inner wall of the second terminal cavity, said second seal further defining a frustoconical second sleeve; and a second seal retainer attached to the connector body having a second retainer tower extending therefrom defining a frustoconical second retainer cavity configured to receive the second sleeve, wherein at least a portion of the second sleeve is in compressive contact an inner surface of the second retainer cavity.

8. The electrical connector assembly in accordance with claim 7, wherein the second retainer is configured to provide strain relief for the second electrical cable and wherein the second retainer and the second sleeve cooperate to dampen vibration of the second electrical cable.

9. The electrical connector assembly in accordance with claim 7, wherein the first retainer is dimensionally identical to the second retainer.

10. The electrical connector assembly in accordance with claim 6, wherein the first retainer is configured to provide strain relief for the first electrical cable and wherein the first retainer and the first sleeve cooperate to dampen vibration of the first electrical cable.

* * * * *